US011708690B2

(12) United States Patent
Singleton

(10) Patent No.: US 11,708,690 B2
(45) Date of Patent: Jul. 25, 2023

(54) TEMPORARY SEDIMENT RETENTION ASSEMBLY

(71) Applicant: SILT-SAVER, INC., Conyers, GA (US)

(72) Inventor: Earl R. Singleton, Oxford, GA (US)

(73) Assignee: Silt Saver, Inc., Covington, GA (US)

( * ) Notice: Subject to any disclaimer, the term of this patent is extended or adjusted under 35 U.S.C. 154(b) by 53 days.

(21) Appl. No.: 16/910,420

(22) Filed: Jun. 24, 2020

(65) Prior Publication Data

US 2021/0404168 A1 Dec. 30, 2021

(51) Int. Cl.
*E03F 5/14* (2006.01)
*E03F 1/00* (2006.01)

(52) U.S. Cl.
CPC . *E03F 5/14* (2013.01); *E03F 1/00* (2013.01)

(58) Field of Classification Search
CPC ... E03F 5/0404; E03F 1/00; E03F 5/06; E03F 5/14; E03F 5/04; E03F 5/125; C02F 2103/001
USPC ..... 210/163, 166, 460
See application file for complete search history.

(56) References Cited

U.S. PATENT DOCUMENTS

| | | | |
|---|---|---|---|
| 217,906 | A | 7/1879 | Shaler |
| 248,559 | A | 10/1881 | Jackson |
| 381,990 | A | 5/1888 | Driller |
| 621,937 | A | 3/1899 | Niemann |
| 770,019 | A | 9/1904 | Neireiter |
| 1,310,055 | A | 7/1919 | Caldwell |
| 1,678,622 | A | 7/1928 | Horne |
| 1,711,674 | A | 5/1929 | Egan |
| 1,791,512 | A | 2/1931 | Schurman |
| 1,964,419 | A | 6/1934 | Asten |
| 2,201,279 | A | 5/1940 | Willing |
| 2,375,345 | A | 5/1945 | Burhans |
| 2,419,501 | A | 4/1947 | Pinto |
| 2,873,896 | A | 2/1959 | Swartz |
| 2,887,073 | A | 5/1959 | Thompson |

(Continued)

FOREIGN PATENT DOCUMENTS

| | | | |
|---|---|---|---|
| AU | 780521 | B2 | 1/2001 |
| JP | 10183593 | A | 7/1998 |
| KR | 2011053584 | A | 5/2011 |

OTHER PUBLICATIONS

HydroCAD® Stormwater Modeling System, Sample Pond #1, pp. 1-4, 1997, www.hydrocad.net/pond1.htm.

(Continued)

*Primary Examiner* — Claire A Norris
(74) *Attorney, Agent, or Firm* — Womble Bond Dickinson (US) LLP

(57) ABSTRACT

A temporary sediment retention assembly for removing sediment from storm water entering an inlet of a storm water drainage system can include a substantially rigid frame and a cover. The cover can include a cover material that includes one or more sections of filter materials. The sections of filter materials can be substantially integrally formed or can be connectable together, and form or define a covering or cap that is adaptable to fit over and substantially cover the frame of the temporary sediment retention assembly for retaining or filtering sediment and debris from water flowing through the temporary sediment retention assembly and into the storm water drainage system.

17 Claims, 5 Drawing Sheets

(56) References Cited

U.S. PATENT DOCUMENTS 2,889,932 A 6/1959 Mackintosh
3,252,484 A 5/1966 Meyer et al.
3,283,788 A 11/1966 Bottomley et al.
3,303,973 A 2/1967 Dootson
3,419,151 A 12/1968 Smith et al.
3,481,475 A 12/1969 Ruthrof et al.
3,517,813 A 6/1970 Thaler
3,537,593 A 11/1970 Ruthrof et al.
3,572,413 A 3/1971 Livingstone
3,628,668 A 12/1971 Huppert
3,695,443 A 10/1972 Schmidt, Jr.
3,699,686 A 10/1972 De Winter
3,713,539 A 1/1973 Thompson et al.
3,724,669 A 4/1973 Thal
3,739,913 A 8/1973 Bogosian
3,762,562 A 10/1973 Okuniewski et al.
3,804,258 A 4/1974 Okuniewski et al.
3,830,373 A 8/1974 Sixt et al.
3,889,851 A 6/1975 Kain
3,904,121 A 9/1975 Geagan
3,966,121 A 6/1976 Littman
3,972,078 A 8/1976 Maki
4,034,428 A 7/1977 Jacuzzi
4,094,790 A 6/1978 Schmidt, Jr.
4,162,863 A 7/1979 Gaudard et al.
4,180,464 A 12/1979 Beane
4,183,368 A 1/1980 Husted
4,268,390 A 5/1981 Cunningham
4,279,535 A 7/1981 Gagliardi et al.
4,302,495 A 11/1981 Marra
4,303,519 A 12/1981 DelVecchio
4,418,432 A 12/1983 Vidal
4,419,232 A 12/1983 Arntyr et al.
4,460,462 A 7/1984 Arneson
4,525,273 A 6/1985 Logsdon
4,594,157 A 6/1986 McGowan
4,606,964 A 8/1986 Widerman
4,658,449 A 4/1987 Martin
4,713,179 A 12/1987 Goedderz, Sr.
4,719,724 A 1/1988 Ditcher
4,734,311 A 3/1988 Sokolowksi
4,756,511 A 7/1988 Wright, III
4,765,352 A 8/1988 Strieter
4,786,214 A 11/1988 Schmidt et al.
4,837,987 A 6/1989 Fender
4,906,367 A 3/1990 Villagomez
4,925,342 A 5/1990 Hendy
4,935,132 A 6/1990 Schaier
4,957,389 A 9/1990 Neathery
4,972,863 A 11/1990 Morrow
5,048,228 A 9/1991 Neveu et al.
5,062,735 A 11/1991 Gaudin
5,089,108 A 2/1992 Small
5,107,635 A 4/1992 Carpenter
5,108,224 A 4/1992 Cabaniss et al.
5,150,499 A 9/1992 Berfield
5,201,497 A 4/1993 Williams et al.
5,220,755 A 6/1993 Roles
5,284,580 A 2/1994 Shyh
5,294,337 A 3/1994 Johnson
5,297,367 A 3/1994 Sainz
5,297,895 A 3/1994 Johnson
5,302,283 A 4/1994 Meuche
5,345,741 A 9/1994 Slater et al.
5,348,419 A 9/1994 Bailey et al.
5,350,526 A 9/1994 Sharkey et al.
5,372,714 A 12/1994 Logue, Jr.
5,380,582 A 1/1995 Neely et al.
5,383,745 A 1/1995 Shannon
5,389,166 A 2/1995 White
5,403,474 A 4/1995 Emery
5,405,539 A 4/1995 Schneider
5,406,966 A 4/1995 Lepkowski et al.
5,407,570 A 4/1995 Hobson, Jr.
5,407,575 A 4/1995 Vinsonhaler
5,427,417 A 6/1995 Lechuga
5,431,991 A 7/1995 Quantrille et al.
5,452,546 A 9/1995 Goddard
5,469,670 A 11/1995 Thaler
5,480,254 A 1/1996 Autry et al.
5,486,287 A 1/1996 Murphy et al.
5,511,903 A 4/1996 Nichols et al.
5,526,613 A 6/1996 Simeone, Jr.
5,573,349 A 11/1996 Paoluccio
5,575,925 A 11/1996 Logue, Jr.
5,585,161 A 12/1996 DiFloe et al.
5,587,072 A 12/1996 Regan
5,592,783 A 1/1997 Jones
5,632,888 A 5/1997 Chinn et al.
5,643,445 A 7/1997 Billias et al.
5,650,065 A 7/1997 Sewell
5,720,579 A 2/1998 Trangsrud
5,720,878 A 2/1998 Bolyard
5,725,782 A 3/1998 Chinn et al.
5,733,444 A 3/1998 Johnson
5,735,640 A 4/1998 Meyer et al.
5,744,048 A 4/1998 Stetler
5,758,868 A 6/1998 Shea
5,776,567 A 7/1998 Schilling et al.
5,795,467 A 8/1998 Schloss et al.
5,843,306 A 12/1998 Singleton
5,862,632 A 1/1999 Zima
5,877,096 A 3/1999 Stevenson et al.
5,895,579 A 4/1999 Schloss et al.
5,928,752 A 7/1999 Newquist
5,948,249 A 9/1999 Scott
5,948,250 A 9/1999 Middleton
5,954,451 A 9/1999 Presby
5,954,952 A 9/1999 Strawser, Sr.
5,966,876 A 10/1999 Neathery et al.
5,980,740 A 11/1999 Harms et al.
5,985,157 A 11/1999 Leckner et al.
6,004,457 A 12/1999 Singleton
6,015,489 A 1/2000 Allen et al.
6,017,166 A 1/2000 Mossburg, Jr.
6,041,944 A 3/2000 Meier
6,059,964 A 5/2000 Strawer, Sr.
6,063,270 A 5/2000 D'Offay
6,093,663 A 7/2000 Ouellette et al.
6,169,045 B1 1/2001 Pike et al.
6,261,445 B1 * 7/2001 Singleton ..... B01D 29/15 210/163
6,294,095 B1 9/2001 Lewis
6,334,953 B1 1/2002 Singleton
6,416,674 B1 7/2002 Singleton et al.
6,428,693 B2 8/2002 Singleton
6,464,428 B1 10/2002 Mikell
6,503,856 B1 1/2003 Broadway et al.
6,551,023 B2 4/2003 Allard
6,558,075 B2 5/2003 Benedict et al.
6,595,721 B2 7/2003 Kincheloe
6,609,852 B2 8/2003 Wimberger
6,616,383 B2 9/2003 Janz
6,649,547 B1 11/2003 Arnold et al.
6,709,579 B1 3/2004 Singleton et al.
6,722,817 B2 4/2004 Benedict et al.
6,723,669 B1 4/2004 Clark et al.
6,749,366 B1 6/2004 Chinn et al.
6,808,623 B2 10/2004 Harris et al.
6,872,029 B2 3/2005 Allard et al.
6,942,425 B2 9/2005 Kincheloe
6,976,808 B2 12/2005 Allard
6,986,621 B2 1/2006 Allard
6,994,489 B1 2/2006 Corr
7,040,838 B2 5/2006 Allard et al.
7,052,207 B1 5/2006 Wimberger
7,074,326 B2 7/2006 Singleton
7,108,783 B2 9/2006 Glazik
7,157,010 B1 1/2007 Wolfe
D539,918 S 4/2007 Denmon
7,208,082 B2 4/2007 Hurst et al.
7,246,968 B1 7/2007 Priest
7,266,926 B2 9/2007 Karow

(56) References Cited

U.S. PATENT DOCUMENTS

| | | | | |
|---|---|---|---|---|
| 7,300,573 | B1 * | 11/2007 | Trangsrud | E03F 1/00 210/163 |
| 7,313,889 | B2 | 1/2008 | Karow | |
| 7,396,471 | B2 | 7/2008 | Wimberger | |
| 7,407,574 | B2 | 8/2008 | Robinson | |
| 7,438,802 | B2 | 10/2008 | Hurst | |
| 7,465,129 | B2 | 12/2008 | Singleton | |
| 7,488,414 | B2 | 2/2009 | Wimberger | |
| 7,534,355 | B2 | 5/2009 | Lockerman et al. | |
| D606,174 | S | 12/2009 | Martin | |
| 7,682,104 | B2 | 3/2010 | Wassman et al. | |
| RE42,695 | E | 9/2011 | Singleton | |
| 8,216,453 | B2 | 7/2012 | Moody et al. | |
| 8,277,646 | B2 | 10/2012 | Singleton | |
| 8,465,231 | B2 | 6/2013 | Christopher | |
| 8,557,109 | B1 | 10/2013 | Sutherland | |
| 8,679,328 | B2 | 3/2014 | Hebert | |
| 8,747,027 | B1 | 6/2014 | Singleton | |
| 8,834,714 | B2 | 9/2014 | Chien | |
| 9,643,113 | B2 | 5/2017 | Farmer et al. | |
| 9,719,240 | B1 | 8/2017 | Montague | |
| 10,113,303 | B2 | 10/2018 | Mardian et al. | |
| 2002/0130070 | A1 | 9/2002 | Roesner | |
| 2003/0159342 | A1 | 8/2003 | Ruiz et al. | |
| 2004/0011731 | A1 | 1/2004 | Sanguinetti | |
| 2006/0133897 | A1 | 6/2006 | Allard et al. | |
| 2006/0133900 | A1 | 6/2006 | Singleton | |
| 2007/0069191 | A1 | 3/2007 | Arnold et al. | |
| 2007/0107114 | A1 | 5/2007 | Zahner | |
| 2008/0112766 | A1 | 5/2008 | Kerman | |
| 2008/0237100 | A1 | 10/2008 | Wimberger | |
| 2008/0251470 | A1 | 10/2008 | Kent | |
| 2008/0308477 | A1 | 12/2008 | Hurst | |
| 2009/0014371 | A1 | 1/2009 | Cook | |
| 2009/0173699 | A1 | 7/2009 | Wacome | |
| 2010/0065491 | A1 | 3/2010 | Bussey et al. | |
| 2010/0248574 | A1 | 9/2010 | King et al. | |
| 2011/0305530 | A1 | 12/2011 | Hunt | |
| 2014/0154018 | A1 * | 6/2014 | Singleton | E02D 3/005 405/302.7 |
| 2016/0251866 | A1 | 9/2016 | Greenwald | |
| 2017/0284077 | A1 | 10/2017 | Deurloo | |
| 2018/0195288 | A1 * | 7/2018 | Huber | E04D 13/0409 |
| 2019/0151781 | A1 | 5/2019 | Rastegar | |

OTHER PUBLICATIONS

HydroCAD® Stormwater Modeling System, Sample Pond #2, pp. 1-2, 1997. www.hydrocad.net/pond2.htm.

Catch Basin Erosion Barrier® As Manufactured by Royal Anchor Systems, Inc., Infra-Safe™, which may have been made publicly available as early as Jan. 1998.

Amoco; Product Specification for Amoco Style 2130, issued May 21, 1999.

Geotex, "Geotextiles for Sediment Control" Specification sheet for "Silt Fence".

Georgia Soil and Water Conservation Commission; "Curb Inlet Filter"; Field Manual for Erosion and Sediment Control in Georgia, 3rd Edition, pp. 86-87; 1997.

Georgia Soil and Water Conservation Commission; "Curb Inlet Protection"; Manual for Erosion and Sediment Control in Georgia; Fifth Edition, pp. 6-140; 2000.

Georgia Soil and Water Conservation Commission; "Curb Inlet Filter"; Manual for Erosion and Sediment Control in Georgia; Fifth Edition, pp. 6-144; 2000.

* cited by examiner

TEMPORARY SEDIMENT RETENTION ASSEMBLY

TECHNICAL FIELD

The present disclosure generally relates to filtering sediment and debris from collecting in storm water drainage systems, and in one aspect, to temporary sediment retention assemblies, systems, etc., and methods for protecting openings of a storm water drain system and filtering or otherwise preventing sediment and debris from being washed and/or being deposited into the storm water drainage system, while still enabling water to pass into the inlet.

BACKGROUND

In the construction of residential and other types of developments, a road system generally is first marked out and the streets into and through the development are cut and graded. Thereafter, the storm water drainage system for the development is constructed, typically including underground drainage pipes, collection boxes and culverts, and inlets. The inlets generally can include cylindrical concrete pipes that are installed vertically, but can also include square or V-grate type inlets, and/or other types or configurations. The lower ends of the inlets connect to the collection boxes and the drainage pipes of the storm water drainage system, while their upper ends being substantially at or above street level, forming manholes or drain openings along the street.

Until a street has been substantially completed, drainage pipes and inlets must be kept substantially free of sediment and debris pursuant to various state and county building codes. Keeping sediment and debris out of the drainage system however can be very difficult to accomplish as during grading of the roads and curbs, as well as additional grading on site, sediment and debris typically is pushed to the sides of the street by motor graders, bulldozers, and thus may pass into the upper ends of the inlets. In addition, rain, runoff, wind, etc. also tend to wash or blow sediment and debris into the open ends of the inlets, which will then collect in the collection boxes and storm water drainage system.

Devices such as the Silt Saver frame & filter assembly have been developed to provide a system for temporarily protecting and preventing sediment and debris from enter the drainage pipes. And, such devices have been effective in preventing sediment and debris from entering drop inlets and other, similar drainage pipes. However, drainage inlets and other, similar devices needing protection can vary in size and shape, particularly as new uses and new drainage structures are developed, and it is important for filter assemblies or structures for filtering sediment for runoff water to be securely mountable to such newer and various existing inlet designs, so that sediment and debris can be substantially deposited or filtered from runoff water flows and to guard against collapse or shifting of the filter assembly during high winds or other weather conditions.

Accordingly, a need exists for adaptable sediment retention and filter assemblies that can filter or remove sediment, dirt, and debris from runoff water flows and prevent such materials being washed or blown into a storm water drainage system, and that addresses the foregoing and other problems in the art.

SUMMARY

Briefly described, the present disclosure is, in one aspect, directed to methods and systems for providing a temporary and substantially rigid sediment retention assembly for protection of drainage openings or inlets of storm water drainage systems from ingress of sediment and debris.

In embodiments, a temporary sediment retention assembly can be configured for filtering water or other liquids entering an inlet or a range of varying size and/or configuration inlets or other openings of a variety of storm water drainage systems. The temporary sediment retention assembly generally can include a substantially rigid frame or body configured to seat over and substantially cover an inlet, or range of inlets, of a storm water drainage system(s), and a filter material assembly or cover that is adaptable to fit or be received over and substantially cover and/or enclose the rigid frame.

In some constructions, the substantially rigid frame or body can include a series of spaced, vertically extending slats, ribs, or other frame structures defining the frame, and a plurality of openings or passages defined therethrough to allow for the passage of water or other liquids through the frame and into the storm water drainage system. For example, the slats can be spaced from one another to define a series of spaced openings or passages that enable the flow of water through the sediment retention device while blocking passage of large debris, sediment and sediment. In additional or alternative constructions, the frame or body can include one or more substantially solid walls with openings defined therethrough or that is otherwise constructed with openings or passages to enable a substantial flow of water or other liquids therethrough.

The frame can include a first or upper portion (e.g., having a cylindrical shape, dome shape, etc.), and a base or second, lower portion formed with or connectable to the upper portion at or adjacent a lower end of the upper portion. The base can have varying constructions, shapes, or configurations, including, but not limited to, one or more round, square, rectangular, triangular, or polygonal shapes or other constructions, that can be selected or adapted to correspond to a particular size, shape, or configuration of an inlet or range of inlets with which the temporary sediment retention is to be used.

In some implementations, a temporary sediment retention assembly can include a plurality of different bases that are interchangeably connectable to the upper portion of the frame or body, such that the frame or body is adaptable to correspond to a range of differing size and/or constructions of inlets or other drainage structures.

The base (or bases) further can include one or more movable portions or adapters or that are configured to extend coverage of the temporary sediment retention assembly to overlap and cover additional areas and substantially eliminate gaps in coverage over the inlet through which sediment or debris can pass.

In some embodiments, the cover can include a cover material formed from a filter or screening material having one or more filter or screening sections, such as a sheet(s) of filtering material, and shaped, dimensioned, sized, or configured to correspond to, fit over, or otherwise be at least partially received over the frame and extend over at least a portion of the base. The cover further can be designed to be adaptable to various constructions, shapes, or configurations of bases. The cover material also can include a plurality of filtering or screening materials or have a plurality of filter material sections that form a multistage filter.

The cover can include at least one filter material or filter material section that has a plurality of openings with a first opening size that facilitates substantial sediment retention, e.g., for deposition and filtering sediment particles of sizes that meet or exceed federal, state and county regulations for storm water filtration and control; and further can include at least one filter material or filter material section having a plurality of openings with a second larger opening size that facilitates substantial water release therethrough, e.g., to define one or more release zones or stages along the temporary sediment retention assembly. However, the cover can include a single filter material that provides substantial sediment retention and adequate water release/passage without departing from the scope of the present disclosure.

With the cover fitted on or about the frame, each filter material (or material section) generally can extend for a prescribed amount in a substantially vertical direction along the frame and can extend horizontal direction, substantially around the periphery or circumference of the frame. In some aspects, the opening sizes of the filter material(s) or material section(s) can increase, decrease, or change based on their respective vertical positions along the frame. In some constructions, openings with larger opening sizes can be arranged generally above openings with smaller opening sizes, and in additional or alternative constructions, smaller sized openings can be arranged generally above larger sized openings.

The cover further can include a top cover portion that is configured to fit over and substantially cover the upper portion of the rigid frame; and a bottom cover portion that is designed or adaptable to be at least partially fitted over the base and other bases having a particular construction, shape, or configuration that are connectable to the rigid frame (or connectable to or formed with other rigid frames).

The temporary sediment retention assembly also can include a plurality of retention sections or portions formed with or connectable to the cover and configured to help to substantially secure the cover to the frame or body and/or to help to substantially secure the rigid frame in place over the inlet of the storm water drainage system. For example, the retention portions can include receptacles, such as pouches, pockets, etc., which can be coupled to or formed with the bottom portion of the cover and configured to receive a ballast, such as rocks, weights, or other weighted materials, to help to substantially secure the cover or rigid frame.

Various objects, features and advantages of the present invention will become apparent to those skilled in the art upon a review of the following detail description, when taken in conjunction with the accompanying drawings.

BRIEF DESCRIPTION OF THE FIGURES

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION

The following description, taken in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
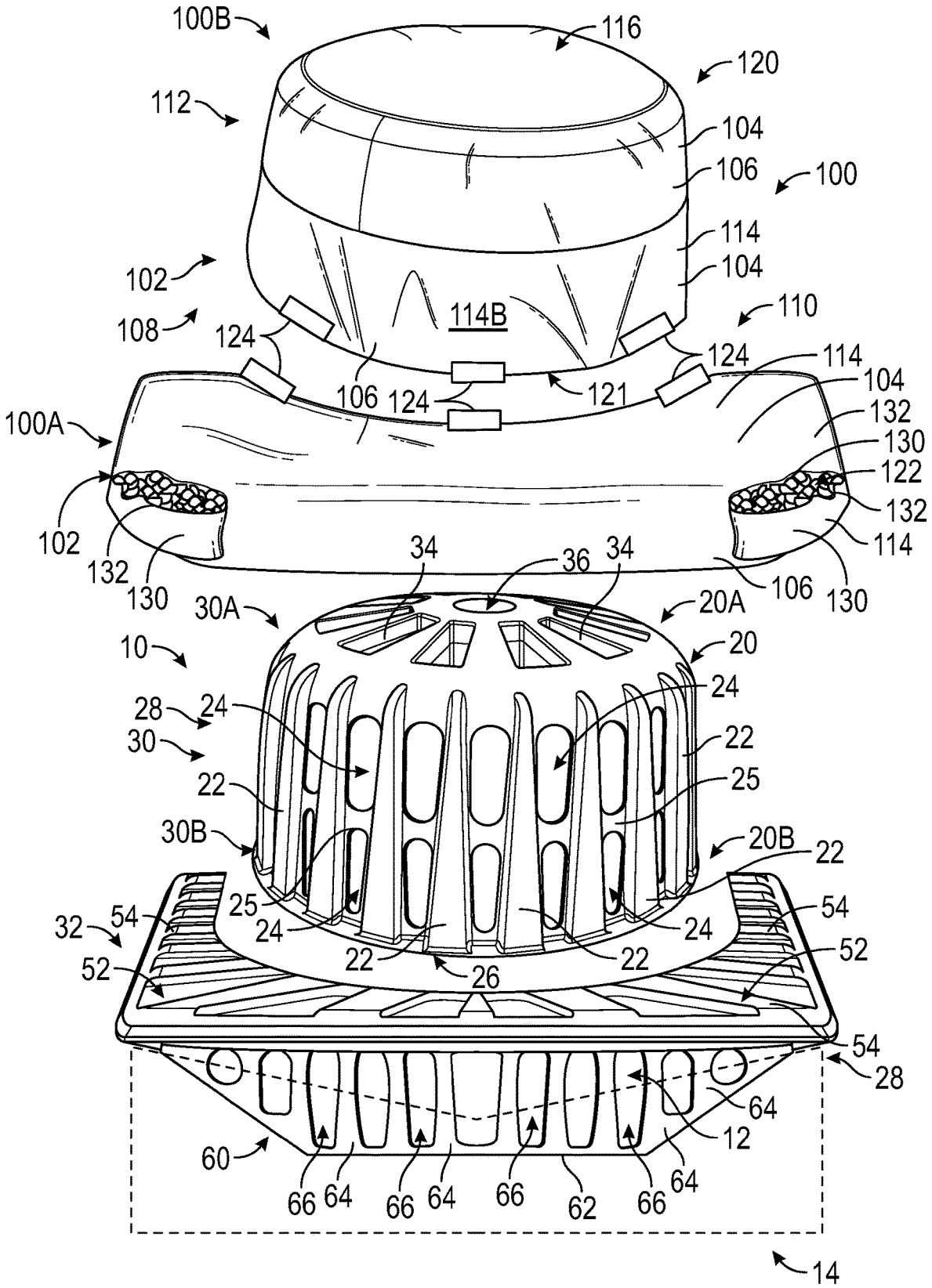
FIG. 1 shows an exploded view of a temporary sediment retention assembly according to one example of the present disclosure.

Referring now to the drawings in which like reference numerals indicate like parts throughout the several views, FIGS. 1-3D illustrate a temporary sediment retention assembly or system 10 for filtering water, e.g., storm water, run-off water, etc., or other liquids, entering at least one specifically sized, shaped, or configured inlet 12 of a storm water drainage system 14 according to principles of the present disclosure. The sediment retention assembly 10 generally is designed as temporary but stable system for covering and protecting a drainage inlet 12, such as a drop or curb or gutter inlet of a storm water drainage system 14 (FIGS. 1 and 3A-3B). The sediment retention assembly 10 can substantially inhibit, reduce, or prevent ingress of sediment, debris, etc. . . . , into the inlet 12, such as during grading or other work on a construction site, e.g., for a roadway, structure, and/or any other suitable commercial or residential construction site. As a result, the sediment retention assembly 10 can help to substantially inhibit, reduce, or prevent sediment and debris from collecting or otherwise accumulating within the underground pipes of the storm water drainage system 12, while also enabling drainage of filtered water, e.g., run-off water, storm water, etc., into and through the storm water drainage system 12. Typically, the storm water drainage system 12 includes underground pipes, such as concrete or metal drainage pipes, and/or collection boxes, with inlets 12, such as a drop inlet, or other types of drainage inlets in communication therewith. Various types of inlets of storm water drainage systems are shown and described in U.S. patent application Ser. No. 16/717,397, which is specifically incorporated by reference herein as if set forth in its entirety.

As indicated in FIG. 1, the temporary sediment retention assembly 10 will include a substantially rigid frame 20 that is configured to seat over and substantially cover an inlet 12 of a storm water drainage system 14. The rigid frame 20 can include a spaced series of elongate slats or ribs 22 that extend between upper 20A and lower 20B ends and thereof, and define a plurality of radially spaced openings or passages 24 therebetween. The rigid frame 20 also can have one or more horizontally extending member or cross-supports 25 connecting adjacent slats 22. The sediment retention assembly 10 also has an internal passage 26 defined therein and along which storm runoff water is allowed to pass and drain into an inlet 12 of a storm water drainage system 14. The slats 22 and openings 24 therebetween can be formed with various dimensions (e.g. between approximately ½"-4") as needed to enable water or other liquids to drain through the rigid frame 20 and into the internal passage 26. In some constructions, the temporary sediment retention assembly 10 can include a body with one or more substantially solid walls including openings or passages defined therethrough.

It further will be understood that the dimensions of slats 22 and/or openings 24 may be varied in accordance with the needs of the users of the temporary sediment retention assembly 10 to provide larger or smaller passages. For example, larger passages having various configurations, such as rectangular, triangular, etc. can be used to provide larger open areas, such as at the upper or lower ends of the passages as needed. The rigid frame or body 20 typically can be molded, extruded or otherwise formed from a durable plastic material such as in the polyvinylchloride ("PVC"), acrylonitrile-butadiene-styrene ("ABS"), high density polyethylene ("HDPE"), high molecular weight polyethylene ("HMWPE"), or acetyl resin such as "DELRIN", or any other similar rigid, durable, high strength materials, including wood or metals such as aluminum, that are relatively lightweight for ease of handling.

FIG. 1 further shows that the rigid frame 20 includes a plurality of frame or body portions 28 that are formed or connectable together and which can be designed or selected for a particular application, e.g., to correspond to particularly constructed, configured, etc. storm water drainage system inlet or construction. The plurality of frame portions 28 can include a first or upper frame portion 30, and base or lower, second frame portion 32 formed with or connectable to the upper frame portion 30. The upper frame portion 30 can have a substantially tubular or cylindrical shape or construction, and can have a top section or area 30A that is slightly curved or arched to forming a curved or domed top section or area 30A, as generally shown in FIG. 1, though the upper frame portion 30 can have other domed constructions, such as a low profile dome shape, e.g., without a cylindrical or tubular portion, or other non-domed constructions, e.g., the top area 30A can have other suitable constructions, such as substantially flat or planar constructions, without departing from the scope of the present disclosure. The top area 30A also can include series of radially spaced, upper openings or passages 34, for example, formed as elongated, substantially rectangular or polygonal shaped openings 34 that extend at least partially across the top area 30A. The openings 34 can provide additional passageways for overflow of storm water runoff into an inlet 12. The top area 20A also can include single, substantially centrally located circular or otherwise arcuate opening 36 in place of or in conjunction with the openings 36.

As FIGS. 1 and 2A-2D indicate, the frame base 32 is formed with or attachable to the upper frame portion 30 at or substantially adjacent to a lower end 30B of the upper frame portion 30 to provide a platform for covering and seating the sediment retention assembly 10 over/on the inlet 12 or other drainage structure. The base 32 also generally will have a thickness or other dimensions sized sufficiently to provide stability and weight to the sediment retention assembly 10 when seated on an inlet 14. The shape and outer dimensions of the base 32 further can be selected to correspond to a configuration of the type and shape of inlet 12 over which the temporary sediment retention assembly 10 is to be mounted. In particular, as FIGS. 2A-2D indicate, the frame base 32 can be designed or configured to have a particular construction, shape, or configuration to correspond to a specifically selected sized, shaped, or configured inlet 12 (or other drainage structure) or a range of inlet (or other drainage structure) sizes, shapes, or constructions for a storm water drainage system(s) 14. In this regard, the temporary sediment retention assembly 10 is designed to be adaptable to securely seat upon and be used with storm water drainage system 14 or other similar structures having a variety of different configurations and/or constructions.

In some embodiments, as indicated in FIGS. 1 and 2A-2D, the temporary sediment retention assembly 10 can include a plurality of interchangeable bases 32 that are releasably or detachably connectable to the upper frame portion 30, such that different bases 32 can be selectively exchanged or swapped in and out to adapt or reconfigure the temporary sediment retention assembly 10 to correspond to specifically selected sized, shaped, or configured inlets (or other drainage structure) or ranges of inlet (or other drainage structure) sizes, shapes, or constructions. The bases 32 can be releasably coupled to the upper frame portion 30 by way of a frictional or mating engagement; however, other connection portions or mechanisms, such as releasable fasteners, locks, etc. or other releasable connections portions or mechanisms can be employed. In additional or alternative embodiments, the upper frame portion 30 and base 32 can be substantially permanently connected together, e.g., by one or more substantially permanent connection portions or mechanisms, such as welding, fusing, melding, etc., or integrally formed to provide a substantially unitary structure. For example, the upper frame portion 30 and base 32 can be formed as a single unit formed from a single mold and/or during the substantially same molding process.

Figure 2A:
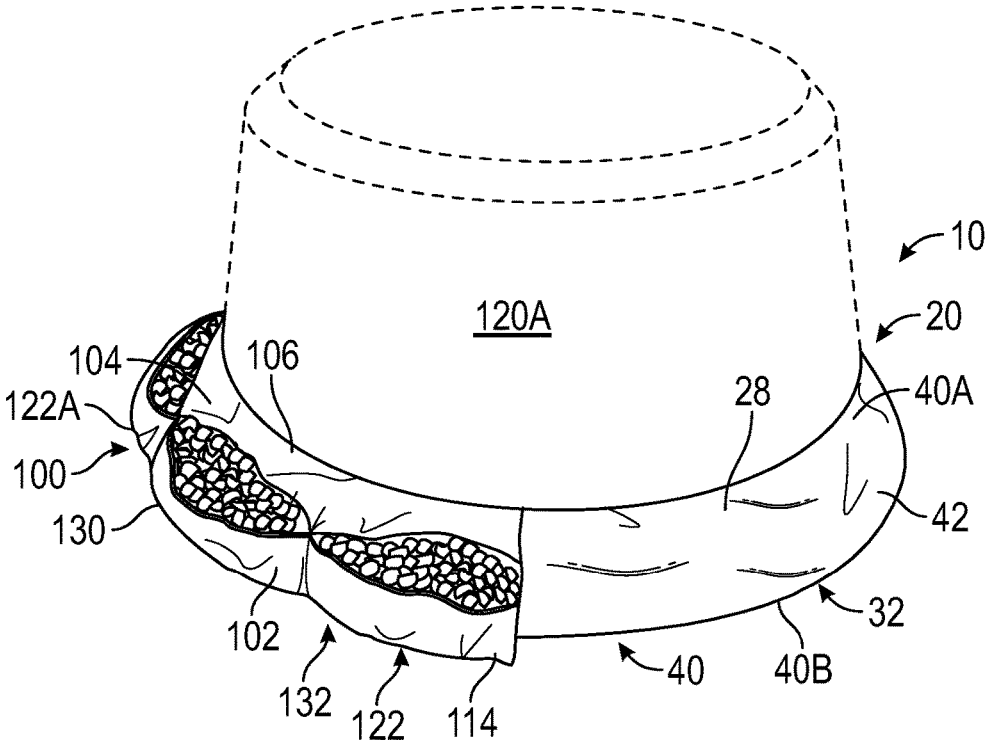
FIGS. 2A-2D show partial cutaway, perspective views illustrating various interchangeable bases for the sediment retention assembly of FIG. 1.

FIGS. 2A-2D show various interchangeable bases 32 or possible base 32 constructions for the temporary sediment retention assembly 10. FIG. 2A shows that the frame base 32 can include a substantially circular or round portion 40 or other suitable construction having a substantially circular or round footprint, e.g., for being fitted over a circular, round, or other suitably configured inlet of a storm water drainage system. In some embodiments, the circular portion 40 can have an outer diameter in a range of about 24 inches to about 120 inches or that is otherwise adapted to fit over an inlet opening of about 12 inches or greater in diameter, though larger or smaller diameters can be selected to correspond to other inlet opening sizes. In some embodiments, the circular portion 40 can have a height or thickness in a range between about 1 inch and about 12 inches. The circular portion 40 in FIG. 2A further is shown to have a substantially solid outer surface 42 that is curved, beveled, or otherwise sloped or slanted from a top end 40A to a bottom end 40B thereof. However, the circular portion 40 can include one or more openings or passages defined therethrough that allow for passage of storm water or other liquid, but substantially reduce, inhibit, prevent passage of sediment and debris.

Figure 2B:
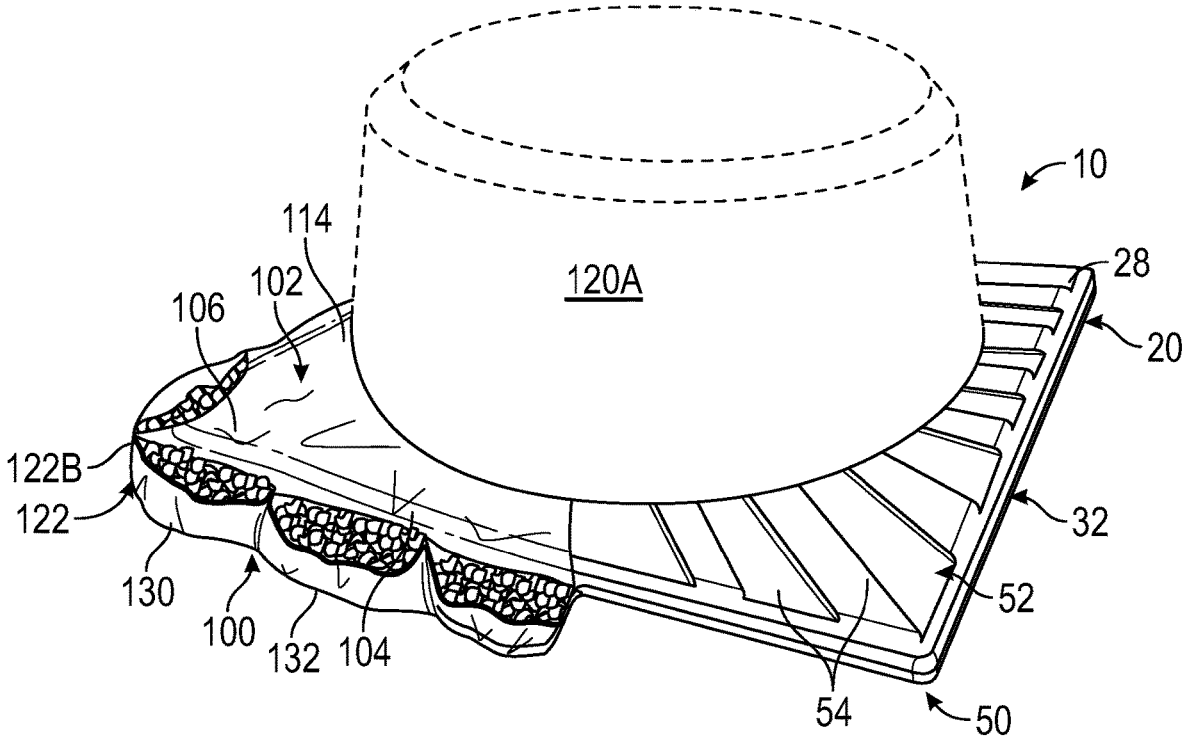
Figure 2C:
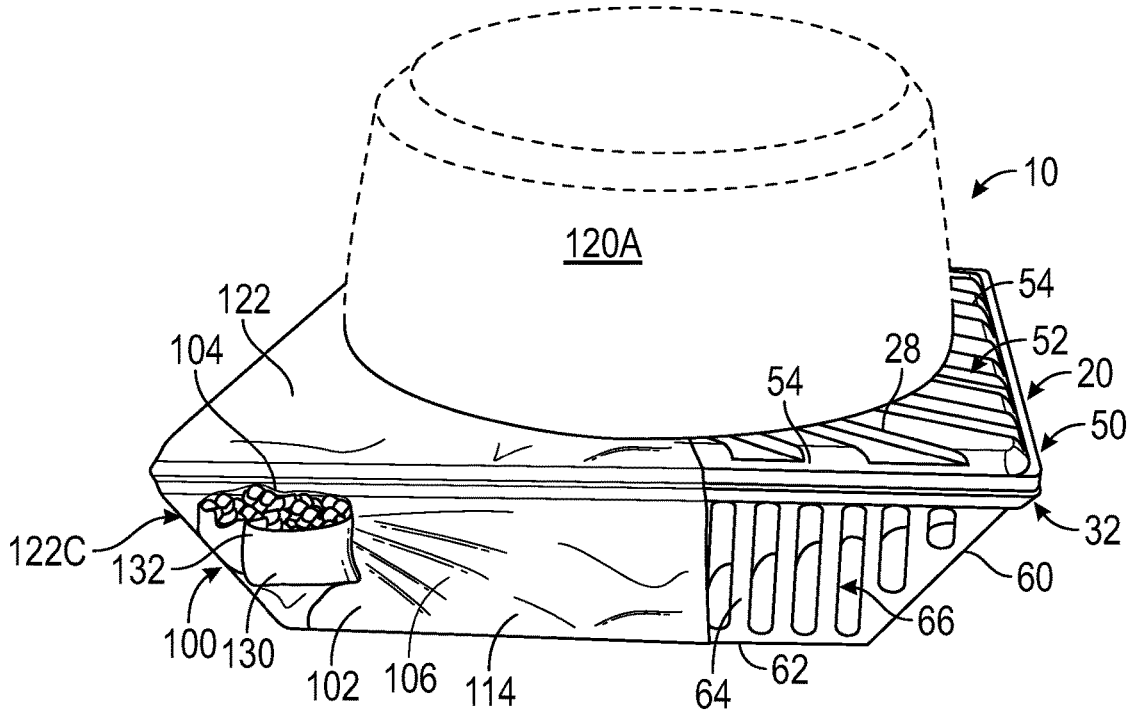
Figure 2D:
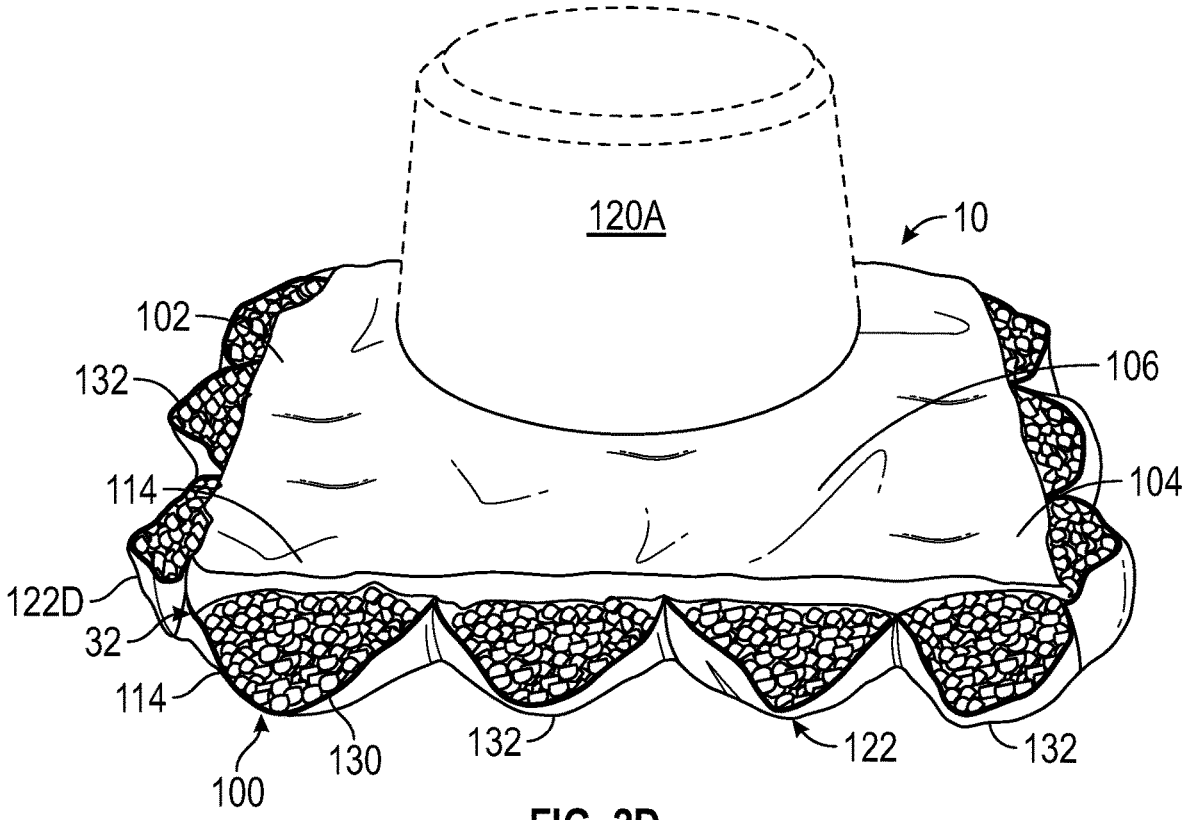

FIGS. 2B-2D shows that the frame base 32 can have a substantially square or rectangular portion 50 or other suitable construction having a substantially square or rectangular footprint, e.g., for being fitted over a rectangular, square, or other suitably configured inlet of a storm water drainage system. In some embodiments, the square or rectangular portion 50 can have a length within a range of about 24 inches to about 120 inches, a width within a range of about 24 inches to about 120 inches, and a height or thickness within a range of about 1 inches to about 12 inches, though other larger or smaller dimensions can be employed, e.g., depending on a size or shape of an inlet or other drainage structure of a storm water drainage system. The square or rectangular portion 50 further can be substantially solid with a generally flat or planar upper surface 52, which can have a series of spaced support or protruding portions 54 provided or formed thereon, though the square or rectangular portion 50 can include one or more openings or passages defined therethrough (e.g., provided or defined between the portions 54) that allow for passage of water or other liquid, but substantially reduce, inhibit, prevent passage of sediment, debris or other solids.

The base or bases 32 are not limited to the constructions shown in FIGS. 2A-2D and can have suitable shape, construction, footprint, configuration, etc., such as oval, triangular, polygonal, etc., shapes or constructions, to correspond to other differently constructed or configured inlets or drainage structures of storm water drainage systems.

In addition, FIGS. 1 and 2C show that the frame base 32 can include one or more movable portions or adapters 60 that are configured to extend coverage of the sediment retention assembly 10 to overlap and cover additional areas and substantially eliminate gaps in coverage through which debris can pass. The movable portions 60 can include a movable frame or body 62 that is flexible or foldable, such that the movable frame can be folded substantially flat and flush with the base 32 for ease of transportation, and for installation over an inlet or other drainage structure, can be moved or unfurled from its flat position into a position to overlap/abut portions or areas of the inlet 12 so as to cover and substantially enclose portions of the inlet/drainage structure not covered by the base 32 and through which debris could potentially pass. The movable frame 62 can include slats or ribs 64 defining openings or passages 66 configured to enable storm water or other liquid to drain through the movable frame 62 and into the inlet 12. It further will be understood that the dimensions of openings or passages may be varied in accordance with the uses of the temporary sediment retention assembly 10, e.g., to provide larger or smaller passages depending on projected water flows such that varying size slots or slots having various configurations such as rectangular, triangular, U-shaped, and so on. The frame base 32 can include two adapters 60 on opposing sides of the base 32, though the base 32 can include fewer, such as one, or more, such as four or more, adapters 60 connected thereto, without departing from the scope of the present disclosure.

FIGS. 1-3D further show that the temporary sediment retention assembly 10 can include a cover 100 including a cover filter material 102 configured to be fitted or at least partially received over the rigid frame 20. The cover filter material 102 is formed from or otherwise includes one or more filter materials 104, or one or more sections of filter materials 104, including flexible, porous filtering materials, such as polyester, polyolefin, polypropylene, or other polymeric filtering materials, though or other suitable filtering materials, such as a plastic, nylon, or wire mesh, or other similar filtering materials or fabrics also can be used. The filter material(s) 104 can include flexible sheets, cloth, fabric, etc. or other suitable flexible material constructions. The filter material(s) 104 generally has a plurality of openings or pores 106 that are generally water permeable but that substantially reduce, inhibit, or prevent the passage or infiltration of solids having a particular size, diameter, etc., such as sediment and other debris; however at least one filter material or material section 104 can be substantially water tight and substantially reduce, inhibit, or prevent permeation or other passage of water or other liquids, without departing from the scope of the present disclosure. In embodiments, the openings or pores 106 of the filter material(s) 104 can have an opening size of about ¼ inch mesh to about 80 sieve mesh (about 177 μm), though smaller or larger opening sizes can be used without departing from the scope of the present disclosure.

In some embodiments, the cover material 102 includes a plurality or assembly of sections of filter materials 104 that are selectively formed or connectable together, such that the cover 100 is designed or adaptable to correspond to one or more portions or components of a rigid frame 20 having a particular construction, configuration, etc., or to a range of rigid frame 20 constructions, configurations, etc. For example, one or more of the sections of filter materials 104 of the plurality or assembly thereof can be specifically tailored for a particular base 32 construction and/or can be expandable, retractable, or otherwise reconfigurable to correspond to a range of base 32 constructions, configurations, etc. The sections of filter materials 104 further can be selected to have different or substantially the same sized openings.

In additional or alternative embodiments, the cover material 102 can include a single substantially uniform material, e.g., that is continuous from a bottom end portion 100A to a top end portion 100B of the cover 10, and which can be configured to have various areas designed or adaptable to correspond to various portions or components of a rigid frame, e.g., at least one area corresponding to a particular base 32 construction and/or can that is expandable, retractable, or otherwise reconfigurable to correspond to a range of base 32 constructions, configurations, etc. . . .

As generally shown in FIGS. 1 and 3A-3D, the filter material sections 104 are arranged vertically or in ascending order from a bottom end portion 100A to a top end portion 100B of the cover 100. That is, each filter material section 104 generally extends vertically at a prescribed amount or to a particular height of the cover 100, and also extends or spans horizontally substantially entirely around a circumference or width of the cover 100. Respective opening sizes, diameters, configurations, etc., of the openings 106 of each of the filter material sections 104 also can increase, decrease, or otherwise change with positioning or arrangement of the filter material sections 104 along the cover 100, e.g., based on a vertical positioning of the filter material sections 104. In this regard, the filter material sections 104 can be positioned or arranged such that the cover material 102 defines a multi-stage filter 108 including at least one sediment retention stage or zone 110 that provides substantial retention of sediment or other particulates, solids, etc., and at least one release stage or zone 112 that allows for substantial water or other liquid release or passage therethrough, while still retaining solids or particulates having a particular size, diameter, dimension, etc.

The sediment retention stage 110 can include one or more filter materials or filter material sections 114 that include openings 106 with opening sizes less than or equal to 30 seize mesh or less than or equal to about 600 μm, such as opening sizes ranging from about 30 sieve mesh (about 600 μm) to about 80 sieve mesh (about 180 μm) or less. Greater or lesser apparent opening sizes also can be used to provide for increased capture of sediment, depending upon the environmental conditions of the site at which the temporary sediment retention assembly is to be used, e.g., the filter material sections 114 can have an opening sizes less than about 100 sieve mesh or less than about 150 μm.

Figure 3A:
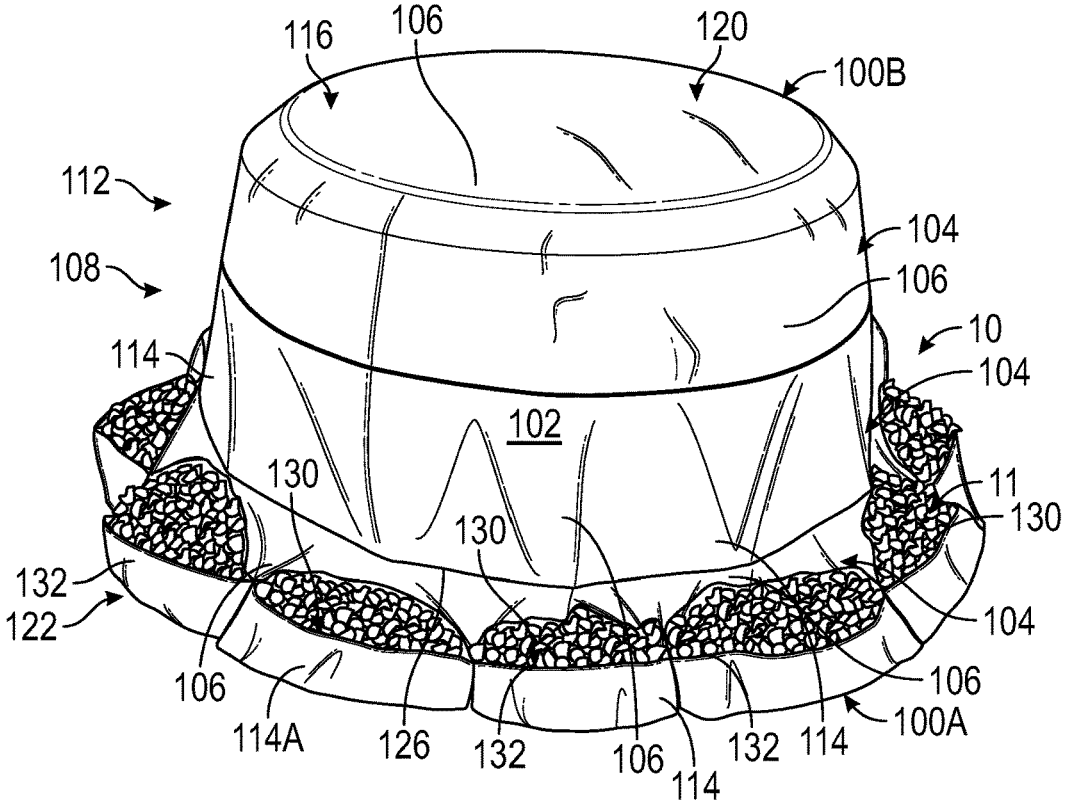
FIGS. 3A-3D each show a perspective views of a temporary sediment retention assemblies according to principles of the present disclosure.
Figure 3B:
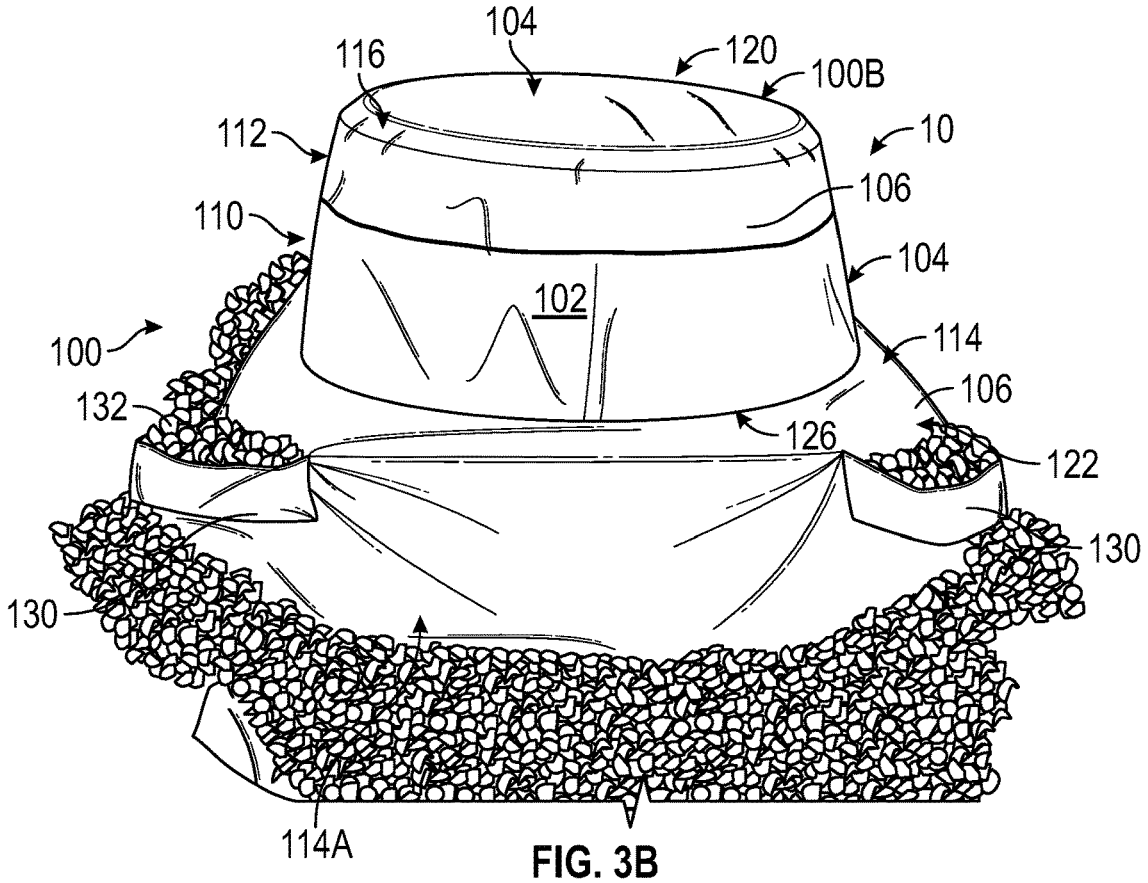
Figure 3C:
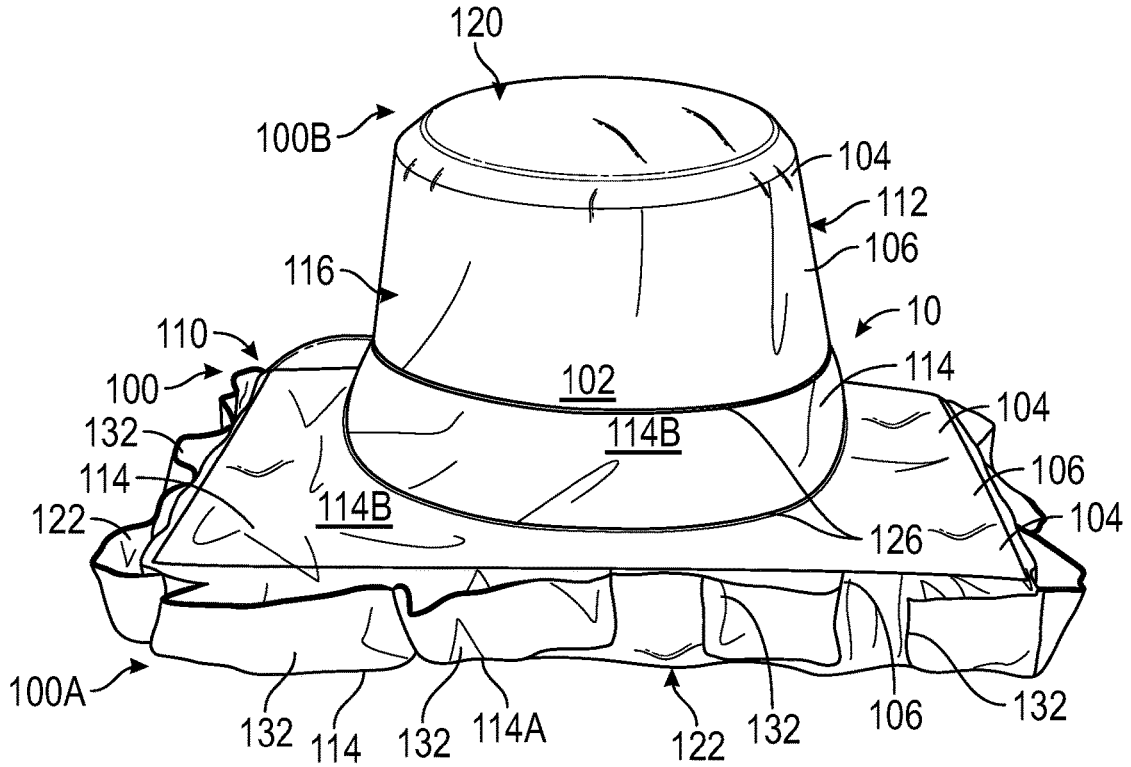
Figure 3D:
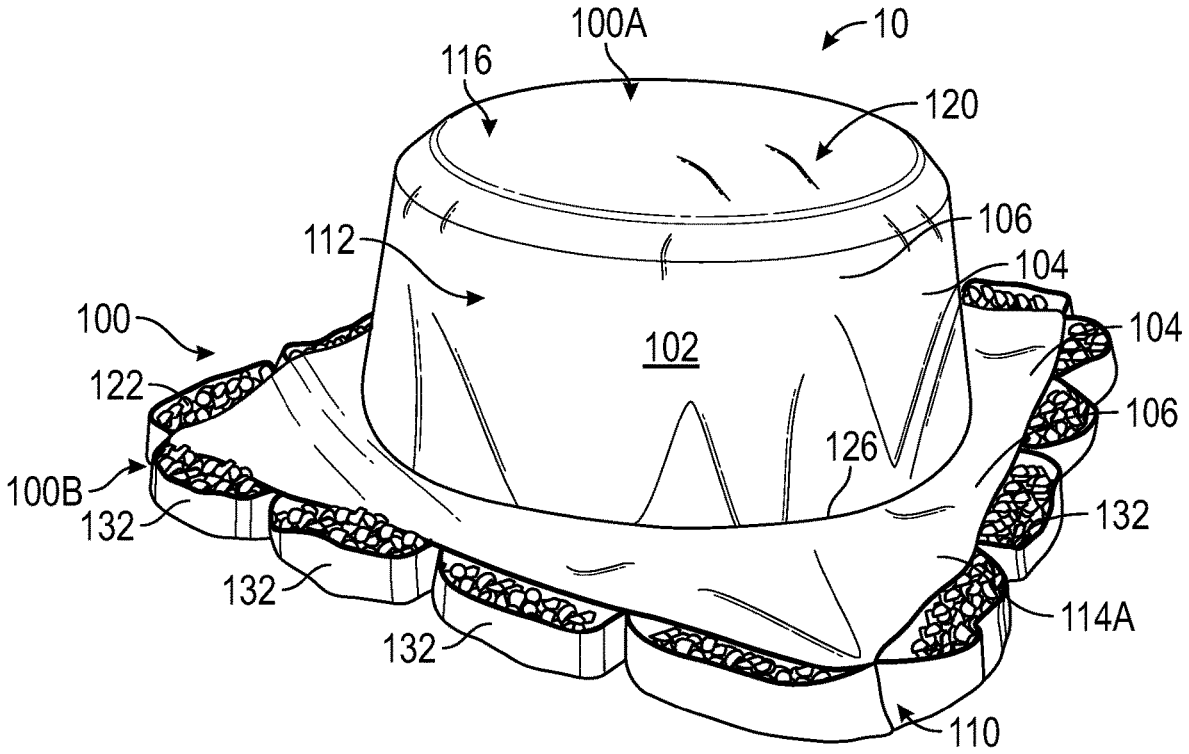

As indicated in FIGS. 1, 3A, and 3C, in some constructions, the sediment retention stage 110 can include a plurality of filter materials (or material sections) 114A, 114B including a filter material 114A having openings with a particular opening size and at least one additional or intermediate filter material 114B having openings with another opening size that is at least slightly larger than the opening size of filter material 114A. For example, the filter material 114A can have an opening size of about 40 sieve mesh or smaller (about 420 μm or less), such as an opening size of about 80 sieve mesh or smaller (about 180 μm or less), and the filter material 114B can have an opening size of about 30 sieve mesh or smaller (about 500 μm or less), such as an opening size of about 70 sieve mesh or smaller (about 210 μm or less). The sediment retention stage 110 also can be formed from three or more filter materials (or filter material sections) having different opening sizes, without departing from the scope of the present disclosure. In other constructions, as generally indicated in FIGS. 3B and 3D, the sediment retention stage 110 can be defined by a single filter material section, such as filter material or filter material section 114A (or filter material/filter material section 114B). Either of the filter material sections 114A or 114B further can have varying opening sizes, such as opening sizes that change, increase, or decrease as they are vertically arranged along the filter material (e.g., with larger openings position above smaller openings or with smaller openings being positioned above larger openings).

FIG. 1-3D further show that the release stage or zone 112 can include one or more filter materials 116 that include a plurality of openings that are larger than the openings of the filter materials, e.g., 114A or 114B, of the sediment retention stage 110, for example, opening sizes equal to or larger than about 30 sieve mess (equal to or larger than 500 μm), such as opening sizes range from about ¼ inch mesh to about 30 sieve mesh. Greater or lesser apparent opening sizes, such as opening sizes larger than ¼ inch mesh, also can be used to provide for higher flow rates as needed, depending upon the environmental conditions of the site at which the temporary sediment retention assembly is to be used. Although FIGS. 1-3D shows only a single filter material or filter material section 116 defining the release stage or zone 112, the release stage or zone 112 can be formed or defined by a plurality of filter materials or sections having different opening sizes. Further, the opening sizes of the filter material or filter material section 116 can vary vertically along the release stage or zone 112, e.g., increase in size from the bottom to the top of the stage or zone 112.

Typically, as indicated in FIGS. 1 and 3A-D, the release stage or zone 112 allowing for substantial water release generally will be positioned on top of or otherwise above the sediment retention stage or zone 110, e.g., with the at least one stage 112 extending from the at least one stage or zone 110 to allow for sufficient pressure or stress release due to water or other liquids impinging on or otherwise engaging the temporary sediment retention in assembly 100. In this regard, as a water level along the temporary sediment retention in assembly 100 rises during use, such as due to a buildup of sediment and debris thereagainst and/or the incidence of increased runoff water flows due to flooding or heavy rains, controlled, incrementally increasing flows of water are enabled to pass through the cover 100 in order to help maintain hydrostatic pressures remain at acceptable levels and to help the temporary sediment retention in assembly 100 remain in place or prevent it from being washed away due to such increased water flow volumes/pressures, while sediment and other debris is still retained at the at least one sediment retention stage or zone 110. However, in some constructions, and when appropriate for certain worksite and/or environmental conditions, the sediment retention stage or zone 110 will be arranged above and extend from the stage or zone 112 allowing for substantial water release.

In some implementations, the plurality of filter material sections or filter materials 104 are substantially permanently secured together, e.g., sewn together, fused together, etc., to form the cover material 102, and in other implementations, the filter material sections 104 can be releasably coupled (e.g., by one or more releasable connectors or fastening assemblies, such as button assemblies, hook and loop, zippers, etc. or other suitable releasable connectors or fastener assemblies) to one another to allow for exchanging or rearrangement of the various filter material sections 104, e.g., to reconfigure the multi-stage filter, to reconfigured the cover 100 to corresponds to a certain base construction or configuration or range of base constructions or configurations.

FIGS. 1-3D further indicate that cover material 102 can be specifically designed or adaptable to correspond to a specific shape, construction, or configuration of the rigid frame 20. In embodiments, the cover material 102 can include a first or top cover portion 120 made up of or otherwise including one or more filter material sections 104 and shaped, dimensioned, sized, or otherwise configured to correspond to and be at least partially received over the upper frame portion 30 of the rigid frame 20. That is, the top cover portion 120 includes a cavity or passage 121 that allows the top cover portion 120 to be fitted over or otherwise receive the upper frame portion 30 of the rigid frame 20, and is generally complementary or otherwise corresponds to the shape, size, construction, or configuration of the upper frame portion 30 of the rigid frame 20, such that the top cover portion 120 of the cover material 102 is sufficiently taut or otherwise under tension when received about the upper frame portion 30 of the rigid frame 32. The top cover portion 120 can be made up of any one of the filter materials 114A, 114B, or 116 or combinations thereof (e.g., two or more of filter materials 114A, 114B, 116 and/or additional filter materials).

In some embodiments, at least part of the top cover portion or upper portion 120 can be dyed or painted with a fluorescent color, such as a bright green, orange, red, etc. This will make the cover 100 and thus the sediment retention assembly itself stand out more prominently and provide a clear and easy to recognize visual indicator of the existence and position of the drop inlet for workers.

In addition, as generally indicated in FIGS. 1-3D, the cover material 102 further includes a second or bottom cover portion or lower portion 122 made up of or otherwise including one or more filter material sections 104 formed with or coupleable to the top portion 120 and that is selectively designed, constructed, or configured and/or reconfigurable or adaptable to correspond to and be at least partially received over a particular construction, shape, or configuration of the frame base 32 or ranges of bases 32. In this regard, the cover material 102 can be substantially connected to the rigid frame 20, e.g., to help with mounting and protection against dislodging of the cover, and sufficiently fitted thereover, e.g., to facilitate substantial sediment retention. The bottom cover portion 122 can be made up of any one of the filter materials 114A, 114B, 116 or combinations thereof (e.g., two or more of filter materials 114A, 114B, 116 and/or additional filter materials).

In one embodiment, the bottom cover portion 122 will be specifically tailored, designed shaped, dimensioned, etc. or otherwise configured to be substantially fitted or received over a certain base 32, i.e., a particular base 32 having a specific construction, configuration, etc., such as round, square, rectangular, etc., base; a base including one or more adapters; etc. In other embodiments, however, the bottom cover portion 122 will be expandable or contractible or otherwise reconfigurable or adaptable such that the bottom cover portion 122 can sufficiently cover, or otherwise be substantially fitted or received over, a range of bases 32 having various different constructions, configurations, etc., with the bottom cover portion 122 of the cover material 102 being sufficiently taut or otherwise under tension.

In one example construction, the bottom cover portion 122 can include one or more sufficiently elastic portions or sections, such as elastic or clinching materials including elastic bands, strands, fibers, yarns etc., and/or other suitable elastic material or clenching materials elastic adapted to enclose the bottom cover portion 122 (e.g., an outer, lower edge thereof) about the base 32. The one or more elastic portions, or materials, can be stretchable or expandable to allow the bottom cover portion 122 to be expanded or stretched out to be fitted or otherwise at least partially received over one or more specifically constructed, configured, etc., bases 32, and also can retract or bias the bottom cover portion 122 towards a retracted or minimized configuration to allow the bottom cover portion 122 to be additionally fitted or at least partially received over one or more differently constructed, configured, etc., bases 32, e.g., with a sufficient tautness or tension.

In other constructions, the bottom cover portion 122 can include one or more sections or areas that are selectively foldable, tuckable, rollable, etc., such that the bottom cover portion 122 is retractable to be fitted or otherwise at least partially received over one or more specifically constructed, configured, etc., bases 32, with sufficient tautness or tension, and that also are un-foldable, untuckable, unrollable, etc., or that can be otherwise unfurled or expanded to be additionally fitted or at least partially received over one or more differently constructed, configured, etc., bases 32.

In even further additional or alternative constructions, the bottom cover portion 122 can include one or more drawstring assemblies, winch assemblies, mechanical fasteners, etc., or other suitable assemblies or mechanisms that are expandable and contractible to allow the bottom cover portion 122 to be fitted or otherwise received over specifically constructed, configured, etc. bases 32 or a range thereof, while maintaining sufficient tautness or tension.

The cover material 102 also can include additional cover portions made up of or otherwise including one or more filter materials 104 that can be used in place of or in conjunction with the top and/or bottom cover portions 120/122, which additional portions can be selectively designed, constructed, or configured and/or reconfigurable or adaptable to correspond to one or more portions of the upper frame portion 30 or base 32.

FIG. 1 further shows that in some constructions the cover assembly 100 includes one or more connection portions or mechanisms 124 for connecting the top 120 and bottom 122 portions (and/or additional portions) together. The one or more connection portions 124 can include releasable connectors or releasable fastener assemblies, such as button assemblies, hook and loop, e.g., Velcro®, zippers, releasable or reusable adhesives, etc. or other suitable releasable connectors or releasable fastener assemblies. In some embodiments, as FIGS. 2A-2D indicate, the cover 100 can include one common upper portion 120A and a series of interchangeable bottom portions 122A-D each selectively designed or constructed and/or adaptable or reconfigurable to correspond to a specifically constructed, configured, etc. base 32, or a range of base 32 constructions, configurations, etc. In this regard, each of the series of interchangeable bottom portions 122A-D can be selectively coupled to the common top cover portion 120A to allow the cover assembly 100 to be substantially fitted over or otherwise received over a rigid frame 20 (or various rigid frames 20) having a base 32 with a specific construction, configuration, etc., or for a range of base 32 constructions, configuration, and which can be removed and replaced with another one of the series of interchangeable bottom portions 112A-D such that the cover 100 can be substantially fitted over or otherwise receive differently constructed, configured, etc., bases 32 or a specific range thereof.

In additional or alternative constructions, the top 120 and bottom 122 cover portions (and/or additional cover portions) can be substantially permanently affixed to one another. More specifically, the top 120 and bottom 122 portions (and/or additional portions) can be fixed together at a one or more joints or seams 126 (FIG. 3A-D), e.g., via sewing, stitching, fusing, one or more adhesives, etc. or other suitable substantially permanent fixing mechanisms.

In one embodiment, shown in FIGS. 1 and 3A-B, and D, the bottom cover portion 122 will include filter material or material section 114A, and in another embodiment, as shown in FIG. 3C, the bottom cover portion 122 will include filter material or material section 114A and filter material or material section 114B, with filter material or material section 114B positioned above and extending from filter material or material section 114A. In these embodiments, the bottom portion 120 will at least partially define the sediment retention stage or zone 110 of the multi-stage filter 108. Further, in one embodiment, shown in FIG. 3D, the top cover portion 120 will include filter material or material section 116 such that the top cover portion 120 at least partially defines the release stage or zone 112 of the multi-stage filter 108. And, in other embodiments, the top cover portion 120 will include the filter material section 116 and filter material 114A (FIG. 3B) or filter material 114B (FIGS. 3A and 3C), e.g., as an intermediate filter material section, such that the top cover portion 120 defines the release stage or zone 112 and at least a portion of the sediment retention stage or zone 110 of the multi-stage filter 108.

As FIGS. 1-3D further indicate, the cover 100 can include a plurality of retention portions 130 connected to or formed with cover material 102 that are configured to help to substantially secure the cover assembly 100 over the rigid frame 20 and/or to help to substantially secure the temporary sediment retention assembly 10 in place, e.g., over an inlet 12 of a storm water drainage system 14. More specifically, the plurality of retention portions 130 can include a plurality of receptacles 132, such as pockets, pouches, flaps, etc., connected to or formed with the bottom cover portion 122 of the cover material 102 and each configured to receive a ballast, such as rocks, sediment, weights, etc. and/or other materials with sufficient weight to substantially secure the cover assembly 100 over the rigid frame 20 and/or to help to substantially secure the temporary sediment retention assembly 10 in place. The receptacles 132 further can be positioned or arranged along the bottom cover portion 122 such that the receptacles 132 are position along or substantially adjacent an outer periphery or outer edge of the frame base 32 or otherwise along the frame base 32 when the bottom cover portion 122 is fitted or received thereover. The retention portions further can include other fastening portions or assemblies, such as hooks, hook and loop, e.g., Velcro®, ties, etc. or other fasting portions or connection members for connecting the cover 100 to the rigid frame 20.

In addition, the cover material 102 can include one or more reinforcing portions, elements, etc. that are configured to reinforce or strengthen the connections between the filter material sections 104 and/or otherwise reinforce or strengthen the cover material 102 (or filter materials 104). The reinforcing portions generally can include various resilient reinforcing materials applied to or formed with the filter materials 104. For example, the reinforcing portions can include areas of increased thickness, increased weaves, etc., of fibers of the filter materials 104, such as areas of increased denier per fiber, and/or other bands, strips, patches, etc. of material, or other reinforcing portion, elements, etc. that provide load support strength, e.g., as hydrostatic pressure is increased against the temporary silt retention assembly 10, such as due to rising storm water flow. The reinforcing portions can be attached to or integrated within the cover material 102 or individual filter materials by weaving, stitching, bonding, such as through the use of adhesives, thermal bonding, or the like, needle punching or other, similar applications, and/or can be attached with fasteners such as staples, hog rings, etc. . . .

The foregoing description generally illustrates and describes various embodiments of this disclosure. It will, however, be understood by those skilled in the art that various changes and modifications can be made to the above-discussed constructions and systems without departing from the spirit and scope of this disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of this disclosure. Accordingly, various features and characteristics as discussed herein may be selectively interchanged and applied to other illustrated and non-illustrated embodiment, and numerous variations, modifications, and additions further can be made thereto without departing from the spirit and scope of the present invention as set forth in the appended claims.

What is claimed is:

1. A temporary sediment retention assembly for removing sediment and debris from water entering an inlet of a storm water drainage system, comprising:

a frame having a plurality of passages defined therethrough and configured to engage and substantially cover the inlet, the frame including an upper portion and base formed with or connectable to the upper portion, the base having a configuration selected for substantially corresponding to a configuration of the inlet of the storm water drainage system so as to cooperatively engage and seat upon the inlet of the storm water drainage system, wherein passages of the plurality of passages extend in each of the upper portion and the base, and wherein the base extends outwardly from the upper portion; and a cover including a plurality of sections of filter material, the cover having an upper portion with a configuration substantially corresponding the upper portion of the frame, and a lower portion that is designed or adaptable to correspond to or fit over the configuration of the base such that the lower portion of the cover extends outwardly over and along at least a portion of the base, wherein the plurality of sections of filter material comprise at least a first section of filter material with a plurality of openings of a first apparent opening size, the first apparent opening size selected to facilitate substantial sediment retention, and at least a second section of filter material with a plurality of openings of a second apparent opening size, the second apparent opening size selected to facilitate substantial release of water or other liquid therethrough, wherein the first section of filter material extends along at least the upper portion of the cover and the second section of filter material extends along at least the lower portion of the filter cover;

wherein at least the first section of filter material and the second section of filter material are detachably connected to each other so that the lower portion of the cover extends outwardly from the upper portion of the cover where the first section of filter material is detachably connected to the second section of filter material.

2. The temporary sediment retention assembly of claim 1, further comprising a plurality of retention portions connected to the cover adjacent the lower portion thereof and configured to receive ballast therein to help substantially secure the frame in a seated, covering alignment over the inlet of the storm water drainage system.

3. The temporary sediment retention assembly of claim 1, wherein the plurality of sections of filter material comprise an upper section including the second section of filter material that facilitates substantial water release therethrough, at least one intermediate section extending along an upstanding side wall portion of the frame and configured with a selected apparent opening size, and a lower section including the first section of filter material that facilitates substantial sediment retention and which is adaptable to fit over and receive varying construction, shape, or configurations of the base that is connected to or formed with the frame.

4. The temporary sediment retention assembly of claim 1, wherein each section of filter material of the plurality of sections of filter material extends vertically along the upper portion of the frame and extends horizontally substantially around a peripheral edge of the frame.

5. The temporary sediment retention assembly of claim 4, wherein respective opening sizes of the plurality of sections of filter material increase, decrease, or change based on their vertical positions along the frame.

6. The temporary sediment retention assembly of claim 2, wherein the plurality of retention portions includes a plurality of receptacles connected to or formed with the bottom portion of the cover and each configured to receive a ballast material to help to substantially secure the cover or frame.

7. The temporary sediment retention assembly of claim 1, further comprising one or more releasable connecting portions configured to releasably couple the one or more sections of filter material together.

8. The temporary sediment retention assembly of claim 1, the lower portion of the cover includes an elastic material or cinching material along a lower edge portion thereof and which is adapted to enclose the lower edge portion of the cover about the base of the frame.

9. The temporary sediment retention assembly of claim 1, wherein the upper portion of the frame comprises a generally dome shaped construction or configuration.

10. The temporary sediment retention assembly of claim 1, wherein one or more openings of the first section of filter material that facilitates substantial sediment retention have an apparent opening size of 500 μm or less, and one or more openings of the second section of filter material that facilitates water release have an apparent opening size of 500 μm or more.

11. The temporary sediment retention assembly of claim 1, wherein the base is shaped, dimensioned, or configured to engage and seat upon the shapes, dimensions, or configurations of various inlets.

12. A temporary sediment retention assembly for removing sediment from water entering storm water drainage systems, comprising:

a substantially rigid frame with a plurality of openings defined therethrough and configured to seat over and substantially cover various sized, shaped or configured inlets of the storm water drainage system, the frame including an upper portion, and a base formed with or connectable to the upper portion at or adjacent a lower end of the upper portion such that the base extends outwardly from the upper portion, the base having a construction, shape, or configuration for corresponding to a size, shape, or configuration of a selected inlet of the storm water drainage system, wherein openings of the plurality of openings extend in each of the upper portion and the base; and a cover configured to be received over and at least partially seat upon the rigid frame, the cover comprising:

a top cover portion comprising at least a first filter material having a plurality of openings with a first opening size that facilitates substantial storm water release therethrough, the top portion being shaped, dimensioned, sized, or configured to correspond to and be at least partially received over the upper portion of the frame;

a bottom cover portion detachably connected to the top cover portion and comprising at least a second filter material with a second opening size that facilitates substantial sediment retention from water passing therethough, the bottom cover portion being adaptable to correspond to the construction, shape, or configuration of the base of the frame so as to engage and substantially cover the base for filtering water passing through the base, the bottom cover portion of the cover extending outwardly over and along at least a portion of the base; and a plurality of retention portions arranged and detachably connected along the bottom cover portion and configured to substantially secure the cover in a filtering position seated over the frame and to help to substantially secure the temporary sediment retention assembly in place over the selected inlet of the storm water drainage system, wherein the plurality of retention portions is spaced outwardly from the top cover portion by at least a portion of the bottom cover portion.

13. The temporary sediment retention assembly of claim 12, the retention portions comprising a plurality of receptacles connected to or formed with the bottom portion of the cover and configured to receive a ballast material to help to substantially secure the cover over the frame.

14. The temporary sediment retention assembly of claim 12, wherein the shape of the selected inlet comprises one or more rounded or polygonal shapes.

15. The temporary sediment retention assembly of claim 12, wherein one or more openings of the first filter material have an apparent opening size of 500 μm or less, and one or more openings of the second filter material have an apparent opening size of 500 μm or more.

16. The temporary sediment retention assembly of claim 12, wherein the base includes one or more movable portions that are configured to extend coverage of the temporary sediment retention assembly to overlap and cover additional areas and substantially eliminate gaps in coverage over the inlet through which sediment or debris can pass.

17. The temporary sediment retention assembly of claim 12, wherein the base is exchangeable with an alternate base selectively connected to the lower end of the upper portion of the frame, wherein the base and the alternate base comprise different geometries.

* * * * *